US005438855A

United States Patent [19]

Ikeda

[11] Patent Number: 5,438,855

[45] Date of Patent: Aug. 8, 1995

[54] VEHICLE DOOR LOCK DEVICE WITH SUPER LOCK MECHANISM

[75] Inventor: Takao Ikeda, Utsunomiya, Japan

[73] Assignee: Mitsui Kinzoku Kogyo Kabushiki Kaisha, Tokyo, Japan

[21] Appl. No.: 84,471

[22] Filed: Jul. 1, 1993

[30] Foreign Application Priority Data

Jul. 2, 1992 [JP] Japan ..... 4-199097

[51] Int. Cl.[6] ..... E05B 47/06

[52] U.S. Cl. ..... 70/279; 292/201; 292/216; 292/DIG. 27

[58] Field of Search ..... 292/DIG. 65, 201, 336.3, 292/DIG. 23, DIG. 24, DIG. 27, 144, 216; 70/283, 279

[56] References Cited

U.S. PATENT DOCUMENTS 1,377,061 5/1921 Deeg ..... 70/283
1,833,572 11/1931 Hardesty ..... 70/283
3,488,075 1/1970 Barnett et al. ..... 292/DIG. 27
4,219,227 8/1980 Grabner et al. ..... 292/201
4,440,006 4/1984 Kleefeldt ..... 70/237
4,492,395 1/1985 Yamada ..... 292/DIG. 27
4,974,886 12/1990 Kleefeldt et al. .
5,154,457 10/1992 Watanabe ..... 292/201

FOREIGN PATENT DOCUMENTS 2227049 7/1990 United Kingdom .

*Primary Examiner*—Peter M. Cuomo
*Assistant Examiner*—Darnell M. Boucher
*Attorney, Agent, or Firm*—Browdy and Neimark

[57] ABSTRACT

A vehicle door lock device has an inside lock lever connected to a lock member on the inside of the door, a key lock lever connected to a key cylinder of the door, and a super lock member for blocking a displacement of the inside lock lever in its unlocking direction after engaging with the inside lock lever at its locked position. The key lock lever has a releasing protrusion adapted to abut on the super lock member in order to release or unlock the super lock when the key lock lever rotates. An engagement of the super lock member with the inside lock lever is adapted to be unreleasable or unlockable by a door-open-operation of the open lever.

6 Claims, 8 Drawing Sheets

VEHICLE DOOR LOCK DEVICE WITH SUPER LOCK MECHANISM

BACKGROUND OF THE INVENTION

1. Industrial Field of the Invention

The present invention relates to a vehicle door lock device with a super lock mechanism. The super lock mechanism means a mechanism making mechanically a lock lever, exchanging a lock device between its locked condition and a unlocked or unlockable condition, undisplacable or unrotatable, expecting to prevent a crime from occurring.

2. Prior Art

According to the conventional vehicle door lock mechanism, when the lock lever is operated to its locked position as well known a connection route between open handles and a latch mechanism of the lock device is cut off. Consequently, operating one of the opening handles installed on the outside and the inside of the vehicle door cannot open the door. However, a crime prevention function of the lock lever above is not complete. For example, if a metal tool is inserted into the door lock device through a gap between the door and the vehicle body in order to rotate the lock lever to its unlock position, it is possible to open the door without a key. It may be an injustice action.

UK2,227,049A discloses a super lock or a lock device with a dead lock mechanism adapted to prevent a lock lever of the lock device from dishonestly exchanging by a metal tool. According to the concrete structure of the super lock, a super lock member which is adapted to displace by motor is adapted to engaged with the lock lever and so that the lock lever doesn't displace except for the engagement of the super lock member with the lock-lever is not disengaged. The conventional lock device fails to have a means to make the locked condition of the super lock disengaged when the motor doesn't work.

Also, U.S. Pat. No. 4,974,886 proposes a lock device with a super lock mechanism enabling to release the locked condition of the super lock mechanism when a door key cylinder manually rotates in its unlock direction even if the motor is malfunctioning However, the manual release means of the conventional lock device has a severe problem. FIG. 10 shows the conventional lock device with super lock mechanism. The lock device is at a unlocked condition when a pin B of the lever A is placed at a lower end of an oval opening D of the open lever C. Rotating the open lever C through a door handle E rotates a lever F through the pin B moving a pin H of a ratchet. Then, a lever A moves to the left by means of another oval opening G. When the pin B is oppositely placed at an upper end of the oval opening D, the lock device becomes of a locked condition. Then, the open lever C is rotated by the door handle E, but the pin B fails to engage with the lever F. The lever A of the conventional lock device is adapted to have a structure of enabling to exchange when a key lock lever J or inside lock lever K rotates. A super lock member L adapted to rotate by means of a motor M has an engagement piece N formed at its lower end. When the engagement piece N is placed below the pin B, the lever A becomes at its unrotatable condition resulting in a super locked condition of the lock device.

Accordingly, even using a metal tool fails to rotate clockwise the lever A by means of the side lock lever K. However, rotating the open lever C moves always the pin B to the left enabling to make a brokage due to the engagement piece N mulfunction.

OBJECT OF THE INVENTION

Consequently, it is a purpose of the present invention to provide a vehicle door lock device with a super lock mechanism having a manual releasing mechanism which operates reliably.

It is another purpose to provide a super mechanism and a manual release mechanism, respectively of a simple structure.

PREFERRED EMBODIMENT OF THE INVENTION

Preferred embodiments of the vehicle door lock device having a super lock mechanism according to the present invention will be described with reference to the accompanying drawings.

Figure 1:
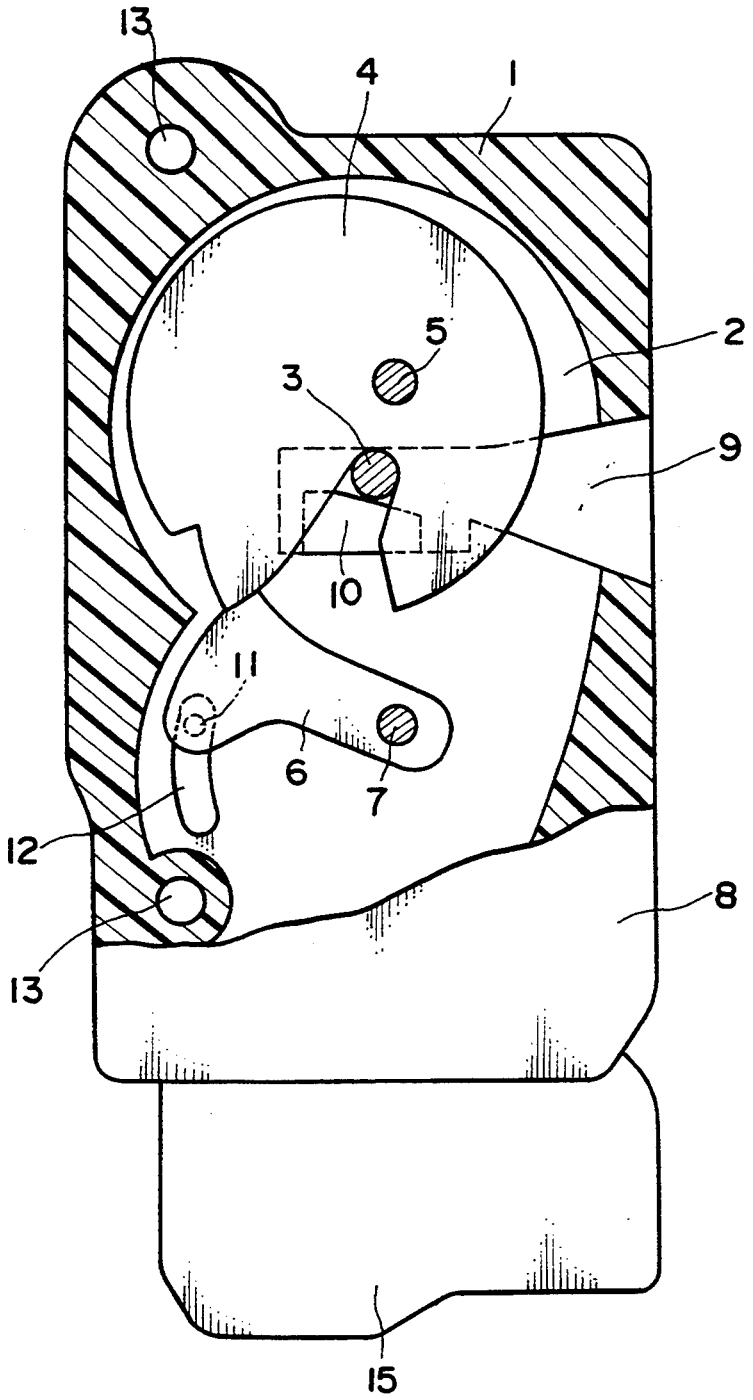
FIG. 1 is a partly-transversal-section front view of the lock device of the present invention.

The body 1 of the door lock device of the present invention is made of a synthetic resin. As shown in FIG. 1, the body 1 has a concave portion 2 formed in the front side of the body 1. There are a latch 4 and a ratchet 6, respectively in the concave portion 2. The latch 4 is journalled by a shaft 5 so as to engage with a striker 3 secured to the vehicle body and the ratchet 6 is journalled by another shaft 7 so as to engage with the latch 4 preventing opposite-rotating of the latch 4.

The body 1 has a convex portion 14 of a section of substantially a letter C. The interior of the convex portion 14 is a passage 9 through which the striker 3 passes. There is a wedge 10 holding the striker 3 in the passage 9.

Figure 6:
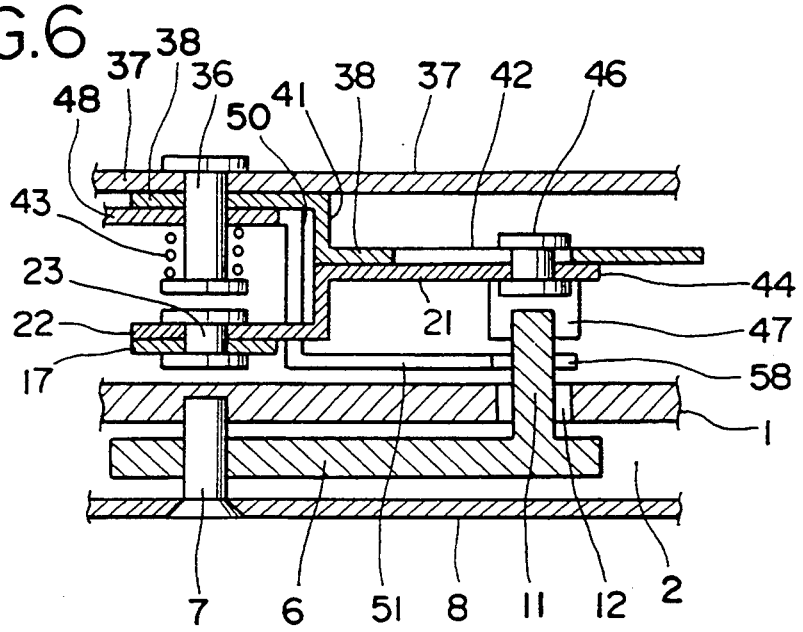
FIG. 6 is a section of the important portion of the lock device.

The ratchet 6 has an engagement pin 11 protruding to the rear of the body 1, which engagement pin being integrally formed with the ratchet 6 (see FIG. 6). The engagement pin 11 protrudes through an arc opening 12 formed in the body 1. The concave portion 2 is closed by a metal-made cover plate 8. The lock device of the present invention is secured to the vehicle door by a screw (not shown) passing through a screw hole 13 formed in the body 1.

Figure 2:
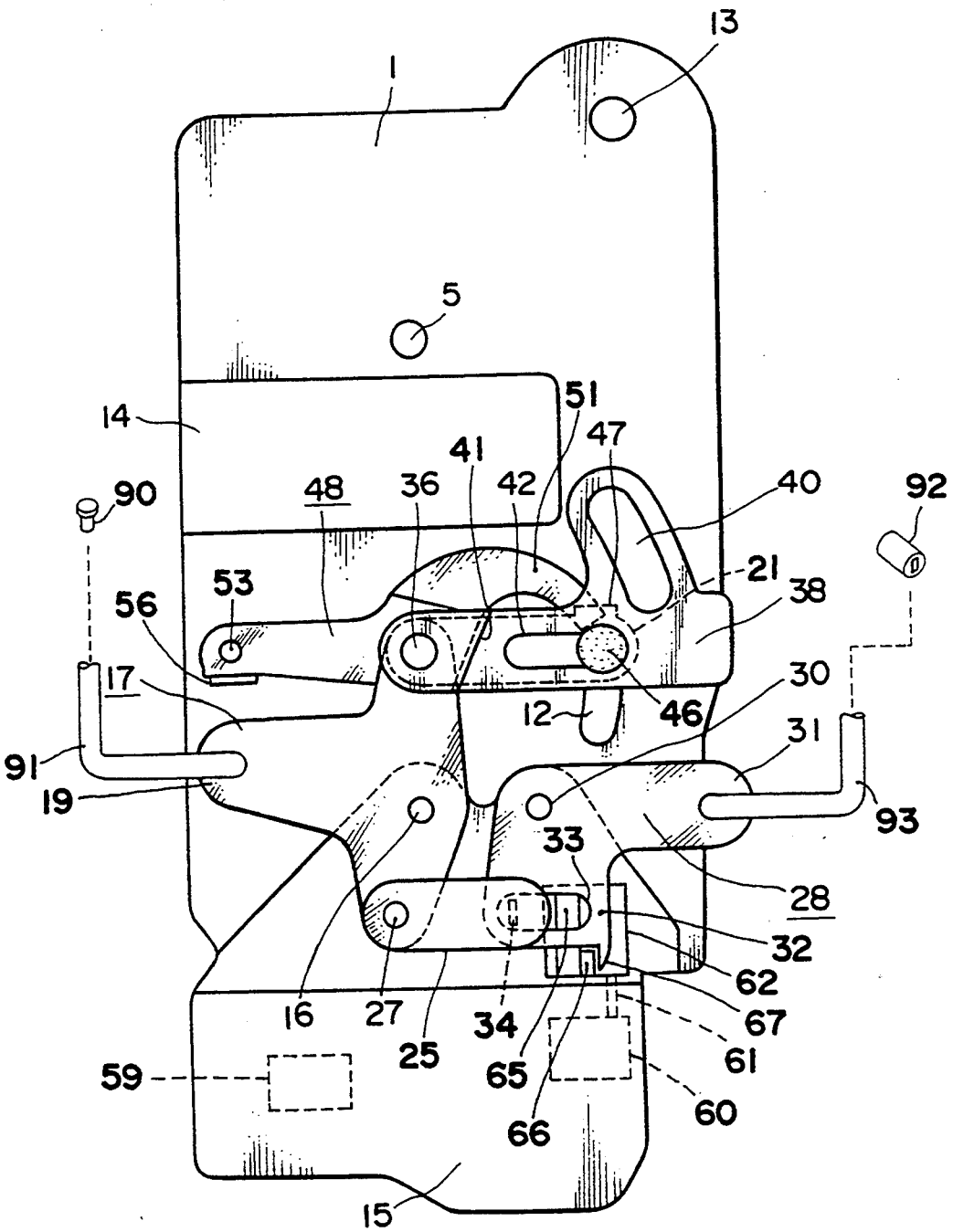
FIG. 2 is a rear view of the lock device at a unlocked condition after its back plate is removed.

An actuator portion 15 is attached to a lower portion of the body 1. The actuator portion 15 has a normal-lock-motor 59 and a super-lock-motor 60. Power of the motor 59 is taken out of the output shaft 16. The output shaft 16 has a journal hole 18 of the inside lock lever 17, which journal hole being inserted thereon and secured there. The lock lever 17 is adapted to rotate, when the output shaft 16 rotates. It is well known that the lock lever 17 exchanges the condition of the lock device between its locked one and unlocked one, so that detailed explanation of the lock lever 17 is omitted from the following description. A unlocked position of the lock lever 17 is shown in FIG. 2 and its locked position is in FIG. 3. The exchanging operation of the lock lever 17 will be explained in detail.

The inside lock lever 17 has three leg portions. A rod 91 extending to an inside lock member 90 of the vehicle door is connected to the first leg portion 19 of the inside lock lever 17, a left end 22 of a link 21 is connected to the second leg portions 20 by a shaft 23 (see FIG. 3 and FIG. 5), and an end 26 of the connection link 25 is connected or journalled to the third leg portion 24 through a shaft 27. In addition, an axis of the shaft 23 overlaps axes of the shaft 36 and shaft 7 of the ratchet 6 when the lock lever 17 resides in its unlocked condition as shown in FIG. 2.

There is a key lock lever 28 of substantially L-shaped is placed by the inside lock lever 17. A shaft 30 passes through a shaft hole 29 of the key lock lever 28 and secured there. A rod 93 extending to a key cylinder 92 of the door is securely connected to a first arm 31 of the key lock lever 28 without a lost motion. When the key lock lever 28 and the key cylinder 92 are firmly connected or both the lever 28 and cylinder 92 are integrally constructed, the lock lever 28 cannot rotate notwithstanding the key cylinder 92 rotates. It is said that only the key for the door can rotate the key lock lever 28.

A second arm 32 extending to below the key lock lever 28 has an arc opening 33 with a radius of the distance to the shaft 30. Through the arc opening 33, a protrusion 34 protruded from other end 35 of the connection link 25 to the front side of the body 1 passes in order to connect the key lock lever 28 to the inside lock lever 17 through the connection link 25. Additionally, a lost motion-constructed by the arc or ellipse opening 33 and the protrusion 34 is formed between the key lock lever 28 and the inside lock lever 17. Due to function of the lost motion, it is possible of the inside lock lever 17 to independently rotate from the key lock lever 28. When the inside lock lever 17 is counterclockwise rotated through the inside lock member 90 in FIG. 2, only the inside lock lever 17 moves to its locked position and the key lock lever 28 doesn't move. When the key cylinder 92 rotates counterclockwise the key lock lever 28 in FIG. 2, the ellipse opening 33 engages with the protrusion 34 and the connection link 25 moves to the right resulting in a counterclockwise rotation of the inside lock lever 17 and the inside lock lever 17 is positioned at its locked position.

Figure 3:
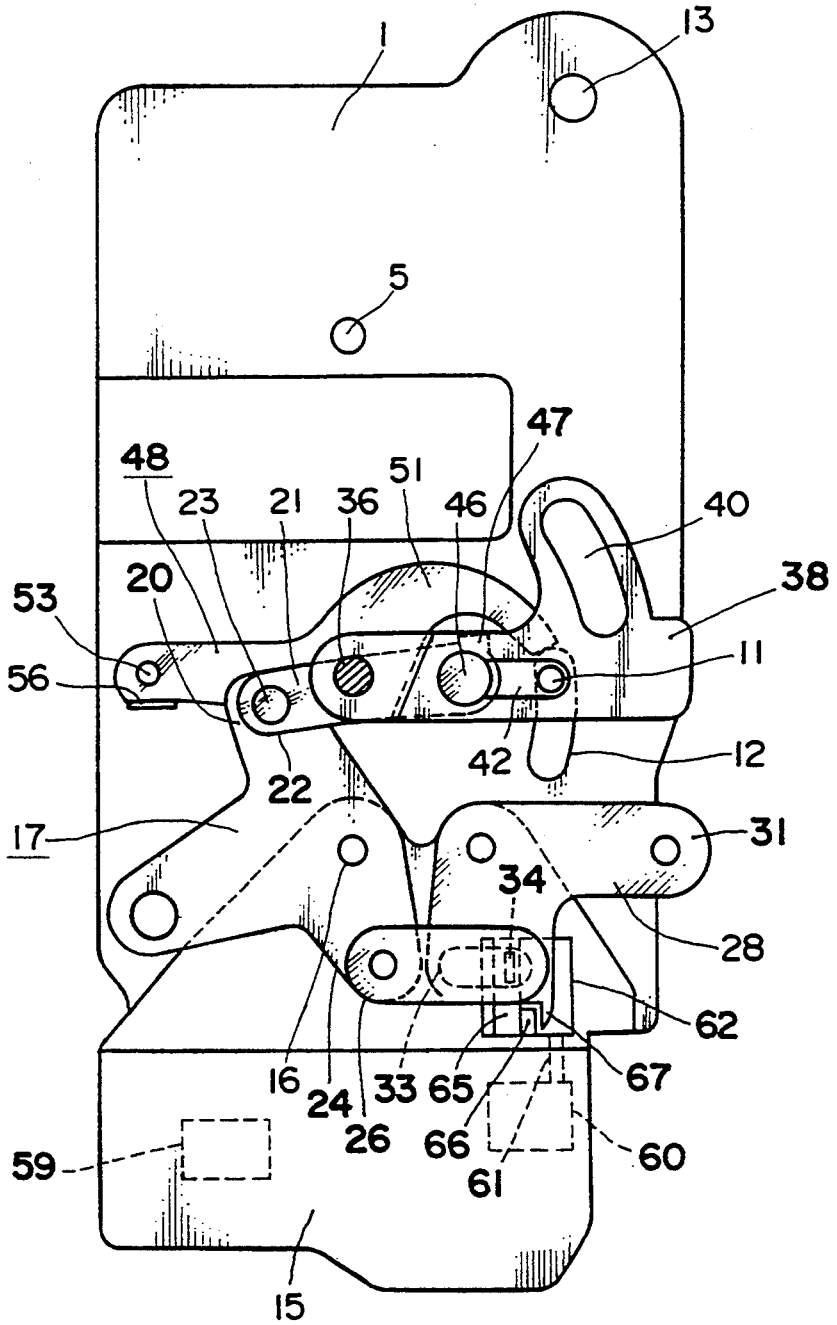
FIG. 3 is a rear view of the lock device at a locked condition after the back plate is removed.
Figure 4:
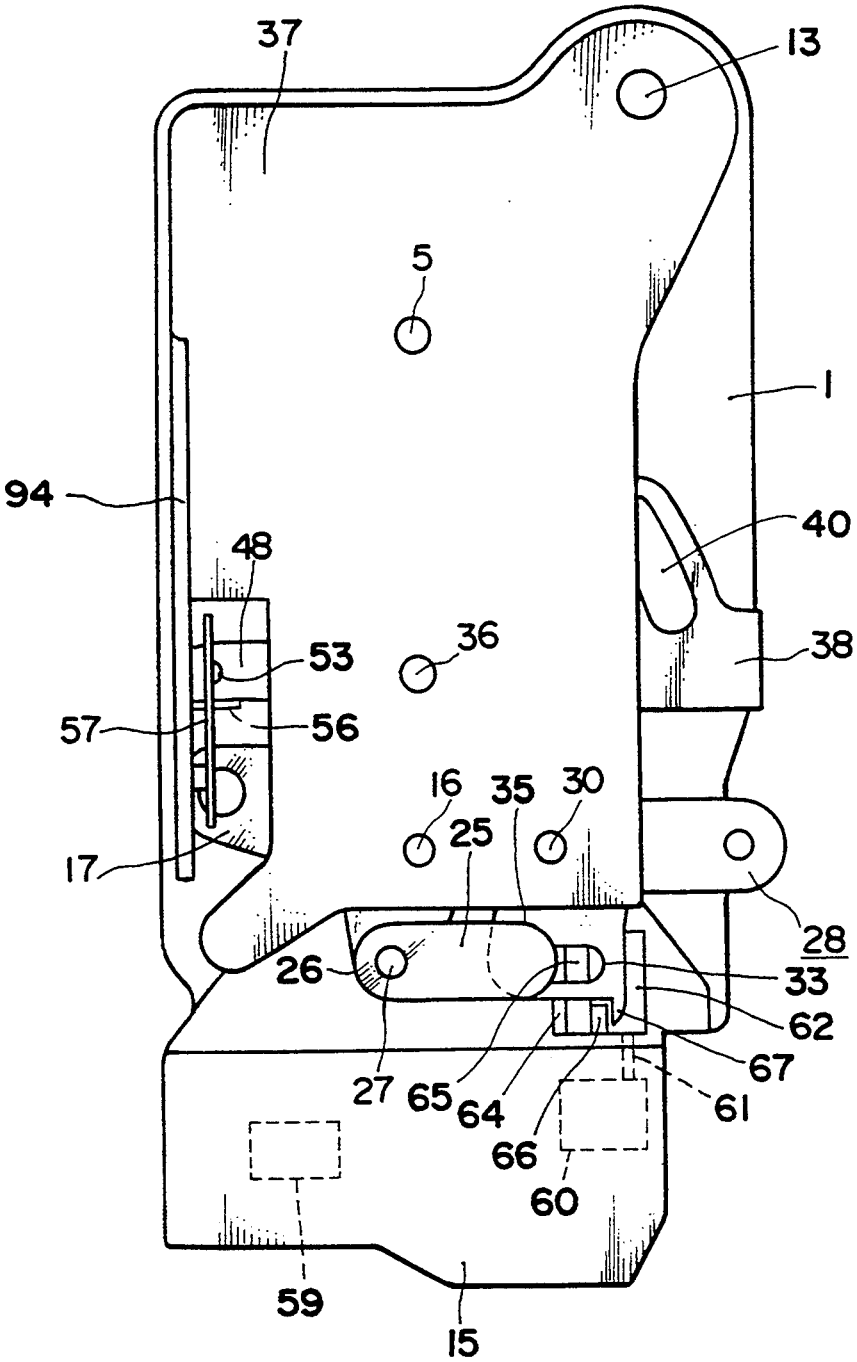
FIG. 4 is a rear view of the lock device.

As shown in FIG. 4 and FIG. 6, a metal-made back plate 37 is attached to the rear side of the body 1. A shaft 36 positioned at the same axis of the shaft 7 of the ratchet 6 is secured to the back plate 37. A shaft hole 39 of the first open lever 38 is rotatably inserted through the shaft 36. The first open lever 38 has an oval opening or hole 40 with a radius of a distance from the shaft 36 formed at its front end portion. A rod (not shown) extending to a outer handle of the door is connected to the oval opening 40. The first open, lever 38 has an oval hole 42 extending along a radial direction of the shaft hole 39 formed therein and a stepped portion 41 (FIG. 5) is formed between the oval opening 42 and the shaft hole 39. The first open lever 38 is urged along a counterclockwise direction in FIG. 2 and FIG. 3 by means of a spring 43 shown in FIG. 5.

The link 21 has a shaft hole 45 formed at its right end 44. A connection pin 46 passes through the shaft hole 45 and the oval opening or hole 42 of the first open lever 38. When operation of the outer handle rotates clockwise the first open lever 38 in FIG. 2, the link 21 too rotates clockwise around the shaft 23 by the connection pin 46. When the inside lock lever 17 is displaced, the link 21 is also displaced in the left and right direction with a guide engagement of the oval hole 42 and the connection pin 46.

The link 21 has an abutting piece 47 bent at a right angle toward the front side, which abutting piece 47 being formed at its right end 44. The abutting piece 47 faces to the engagement pin 11 of the ratchet 6 when the inside lock lever 17 is placed at its unlock position. When the first open lever 38 rotates clockwise the link 21, the abutting piece 47 presses the engagement pin 11 disengaging the ratchet 6 from the latch 4 and making the door enable to open. However, when the inside lock lever 17 is at its locked position, the abutting piece 47 is separated from the engagement pin 11 disenabling the ratchet 6 to move even though the first open lever 38 rotates.

A second open lever 48 has a shape lengthened in a right-and-left direction and a shaft hole 49 formed at its right-and-left direction center is rotatably journalled to the shaft 36. The second open lever 48 has an engagement piece 56 formed at its left portion and an inner lever 57 journalled to a bent portion 94 of the back plate 37 is engaged with the engagement piece 56. An inner handle (not shown) of the door is connected to the inner lever 57.

Figure 5:
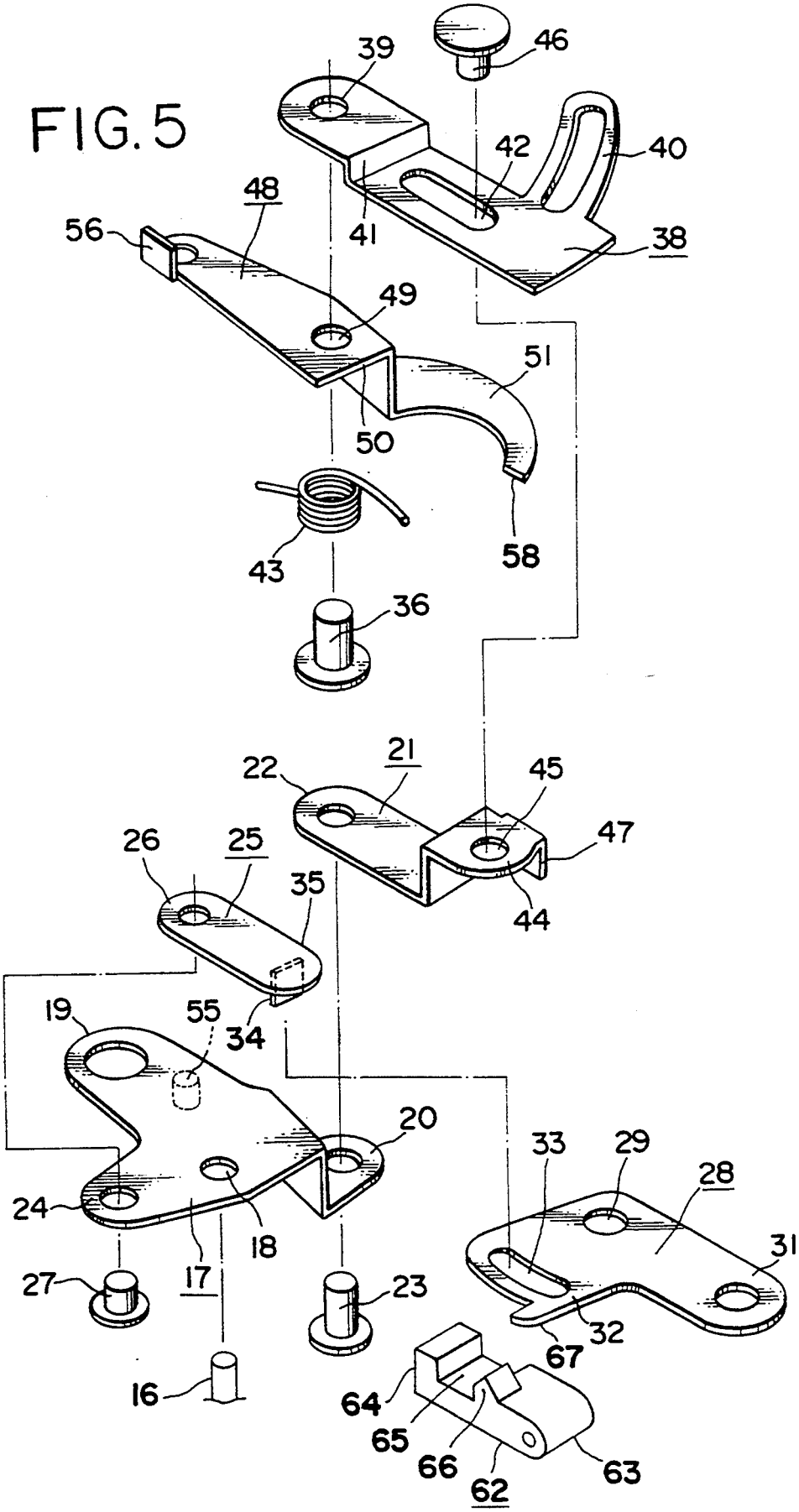
FIG. 5 is an exploded perspective view of various levers of the lock device.

As shown in FIG. 5, the second open lever 48 has formed thereon an abutting face 50 adapted to abut with the stepped portion 41 of the first open lever 38. When the second open lever 48 rotates clockwise by the inner lever 57, the abutting face 50 abuts with the stepped portion 41 of the first open lever 38 rotating the first open lever 38 clockwise around the shaft 36.

The second open lever 48 has an arc arm 51 provided with a front end 58 facing the engagement pin 11. As shown in FIG. 6, the front end 58 is placed below the abutting piece 47. When the second open lever 48 rotates, it abuts directly on the engagement pin 11. As a result, when the inner handle on the vehicle door rotates the second open lever 48, the door will open while it is at a locked condition.

A base portion 63 of the super lock member 62 is secured to an output shaft 61 of the super locking motor 60. The superlock member 62 has a concave portion 65 formed on its front end side 64. When the motor 60 rotates, the super lock member 62 displaces to a super locked position shown by solid lines in FIG. 7 and a released or unlocked position shown by imaginary lines. When the inside lock lever 17 is placed at its locked position and the super lock member 62 moves to its super locked position, a protrusion 34 of the connection link 25 engages with the concave portion 65 consequently disenabling the inside lock lever 17 rotating in its unlocking direction. Basically, the motor 60 is adapted to rotate to a locking direction when the lock device is exchanged from its unlocked condition to its locked condition by means of a manipulation from the outside.

A cam body 66 is formed at substantially a mid position in a left-and-right direction of the super lock member 62 and a unlocking protrusion 67 adapted to abut on the cam body 66 is formed on a front portion of the second arm 32 of the key lock lever 28. When the key lock lever 28 is rotated by a key operation to a unlock side (an arrow direction shown in FIG. 7), the release protrusion 67 abuts on the cam 66 making the super lock member 62 rotate around the output shaft 61 returning it to its release position. In addition, a releasing of super locked condition due to the release protrusion 67 is a safety proof for troubles of the super locking motor 60.

Figure 8:
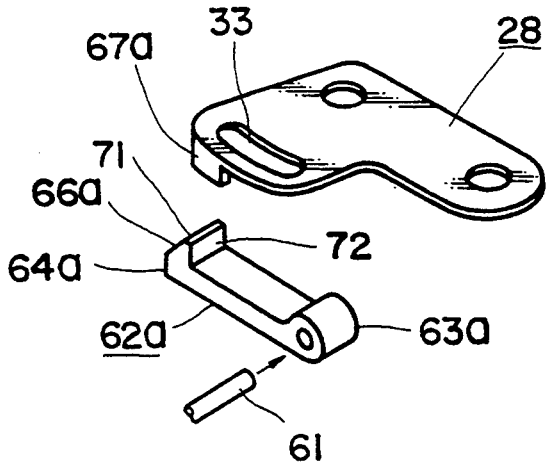
FIG. 8 is a perspective of a super lock mechanism member and a key lock lever according to the second embodiment.
Figure 9:
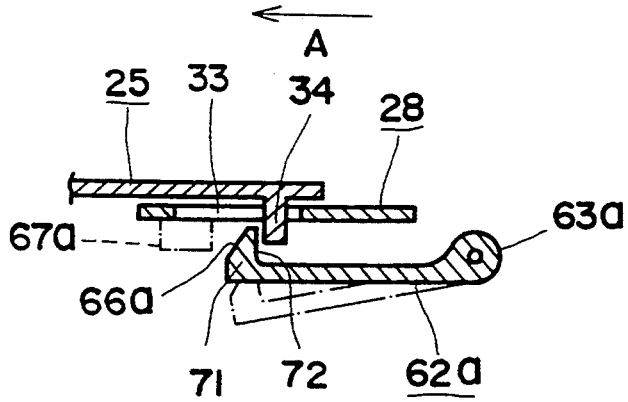
FIG. 9 is a section of operative condition of the super lock mechanism according to the second embodiment.
Figure 10:
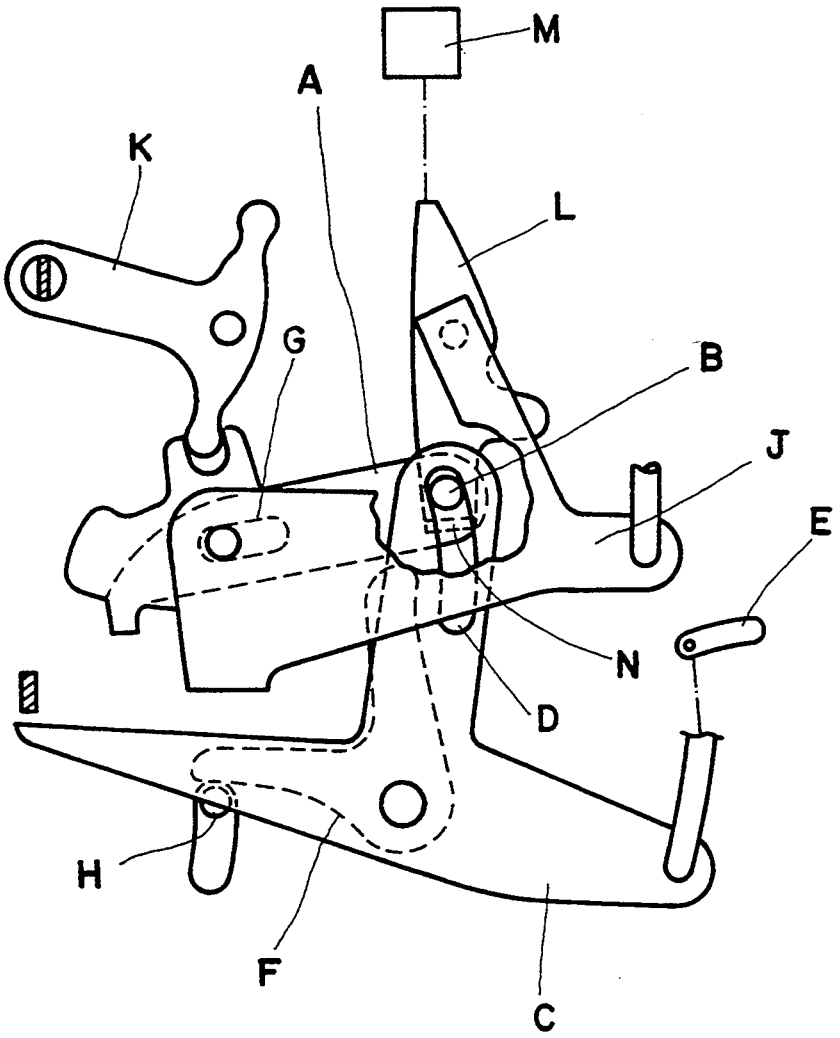
FIG. 10 (PRIOR ART)
FIG. 10 is an elevational view of the conventional lock device.

FIG. 8 and FIG. 9 show the second embodiment of the super lock member. Identical with the first embodiment of the door lock device of the present invention, the output shaft 61 of the motor 60 is secured to a base portion 63*a* of the super lock member 62*a* of the second embodiment. A convex 71 is formed at the front end side 64*a* of the super lock member 62*a*. A slanted cam face 66*a* is formed on the outside face of the convex 71 and a vertical engagement wall 72 is formed on an inner side face of the convex 71. Identical with the first embodiment, a release protrusion 67*a* adapted to abut on the cam face 66*a* is formed on the key lock lever 28. This release protrusion 67*a* of the second embodiment is adapted to abut on the cam face 66*a* in order to return the super lock member 62*a* to its release or unlocked position when the key lock lever 28 rotates an opposite direction of the arrow A shown. That is, according to the mechanism of the first embodiment of the lock device, unlocking rotation of the key cylinder 92 can unlock the super locked condition. On the contrary, in the second embodiment, when the key cylinder 92 rotates its locking direction, the super locked condition is released.

Operation

When the door is closed, the striker 3 entered the passage 9 engages with the latch 4 and the ratchet 6 engages with the latch opening the door (FIG. 1 and FIG. 2).

Then, an outer handle (not shown) is operated to open the door in order to rotate clockwise the first open lever 38, so that the link 21 too clockwise rotates around the shaft 23 through the connection pin 46 and the abutting piece 47 of the link 21 pushes the engagement pin 11. As a result, as shown in FIG. 1, the ratchet 6 rotates counterclockwise and the ratchet 6 disengages from the latch 4 enabling to open the door.

In the condition shown in FIG. 2, entering a key into the key cylinder 92 of the door, it rotates along its locking direction, the key lock lever 28 rotates counterclockwise through the rod 93, and the inside lock lever 17 also rotates counterclockwise through the connection link 25. Consequently, the link 21 connected to the inside lock lever 17 through the shaft 23 moves to the left and the abutting piece 47 is separated or left from the engagement pin 11 obtaining a locked condition of the lock device (FIG. 3).

Figure 7:
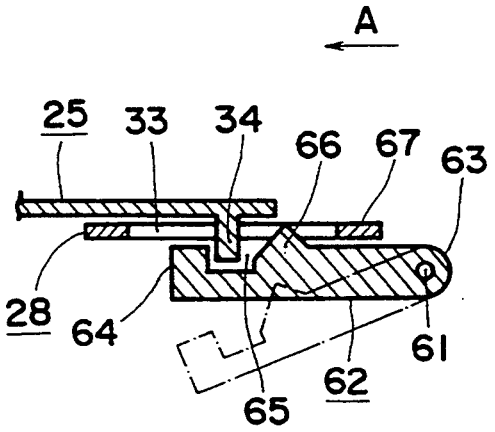
FIG. 7 is a section of operative condition of the super lock mechanism.

Simultaneously, when the shaft 30 of the key lock lever 28 rotates along the locking direction, it is detected by a sensor (not shown), the motor 60 is charged with a current, and the super lock member 62 is displaced to the position shown by solid lines in FIG. 7.

At this condition shown in FIG. 3, if the handle operates to rotate the first open lever 38 clockwise, the abutting piece 47 fails to engage with the engagement pin 11 and the ratchet 6 doesn't move resulting in an impossibility of door opening. In addition, because that the concave 65 of the super lock member 62 is engaging with the protrusion 34 of the connection link 25, it is impossible to rotate the inside lock lever 17 along its unlocking direction or clockwise and any thief is prevented.

When the lock device is locked by the lock member 90 at the inside of the door, the inside lock lever 17 rotates independently because the inside lock lever 17 is connected to the key lock lever 28 through the oval hole 33 by the connection link 25. As a result, as described above, the operation link 21 connected to the second leg portion 20 moves to the left making the lock device of the present invention at a locked condition. The key lock lever 28 or the shaft 30 fails to rotate by a locking operation of the inside locking member 90, so that no power is supplied to the motor 60 for super locking.

Ordinarily, the super locked condition is released by flowing a current to the motor 60 by operation of the key or a portable transmitter. The release operation of the operation of the motor 60 doesn't relate to the gist of the present invention and a detailed explanation on the release operation is omitted from the following description.

Next, a release operation of the super locked condition to be done when the motor 60 has malfunctioned is described.

When the key cylinder 92 of the super lock mechanism of the first embodiment rotates to its unlocking side, the super locked condition is released. In detail, when the key cylinder 92 rotates to a unlocking side, the key lock lever 28 moves along A direction, the release protrusion 67 abuts on the cam body 66, the super lock member 62 rotates to a position shown by imaginary lines, and engagement of the concave 65 with the protrusion 34 is disengaged.

According to the super lock mechanism of the second embodiment shown in FIG. 8 and FIG. 9, rotation of the key cylinder 92 to a locking side enables to release the super locked condition. In detail, when the key cylinder 92 rotates to the locking side, the key lock lever 28 moves alone along an opposite direction of A direction due to a lost motion of the oval hole 33. Then, the release protrusion 67*a* formed on the key lock lever 28 abuts on the cam face 66*a* of the super lock member 62*a* so as to push down the super lock member 62*a* to the position shown by imaginary lines in FIG. 9, releasing an engagement of the engagement wall 72 with the protrusion 34. Then, the lock device can be unlocked by a key or sill knob.

What is claimed is

1. A vehicle door lock device with a super lock mechanism comprising:

a latch engaging with a striker, a ratchet preventing the latch from opposite-rotating, an open lever connected to an open handle of the door; said open lever disengaging the ratchet from the latch and opening the door;

an inside lock lever connected to a door inside lock member; said inside lock lever displacing to a locked position disenabling a door opening operation of the open lever and a unlocked position enabling the door opening operation of the open lever;

a key lock lever connected to a key cylinder of the door; said key lock lever being connected to said inside lock lever through lost motion means for permitting the inside lock lever to rotate independent of the keylock lever;

a rotatable super lock member displaced to a super locked position at which position said super lock member engages with the inside lock lever at the lock position in order to block the inside lock lever from displacement along an unlocking direction and a release position at which position said super lock member is disengaged from the inside lock lever;

a motor displacing the super lock member; and a release protrusion formed on the key lock lever to abut a central portion of the super lock member when the key lock is rotated to unlock and to pivotally displace the super lock member to the release position;

wherein engagement of the super lock member to said inside lock lever is not released by a door opening operation of the open lever.

2. The vehicle door lock device with a super lock mechanism according to claim 1, wherein said lost motion means comprises a link provided with an end connected to said inside lock lever and another end connected to the key lock lever with a lost motion slot, wherein said super lock member engages with said link.

3. The vehicle door lock device with a super lock mechanism according to claim 1, wherein said super lock member is secured to an output shaft of the motor.

4. A vehicle door lock device with a super lock mechanism comprising:

a latch engaging with a striker, a ratchet preventing the latch from opposite-rotating, an open lever connected to an open handle of the door; said open lever disengaging the ratchet from the latch and opening the door;

an inside lock lever connected to a door inside lock member; said inside lock lever displacing to a locked position disenabling a door opening operation of the open lever and a unlocked position enabling the door opening operation of the open lever;

a key lock lever connected to a key cylinder of the door; said key lock lever being connected to said inside lock lever through lost motion means for permitting the inside lock lever to rotate independent of the key lock lever;

a super lock member rotatably displaced to a super locked position at which position said super lock member engages with the inside lock lever at the lock position in order to block the inside lock lever from displacement along an unlocking direction and a release position at which position said super lock member is disengaged from the inside lock lever;

a motor displacing the super lock member; and a release protrusion formed on the key lock lever to abut an end portion of the super lock member when the key lock is rotated to lock and to pivotally displace the super lock member to the release position;

wherein engagement of the super lock member to said inside lock lever is not released by a door opening operation of the open lever.

5. The vehicle door lock device with a super lock mechanism according to claim 4, wherein said last motion means comprises a link provided with an end connected to said inside lock lever and another end connected to the key lock lever with a lost motion slot, wherein said super lock member engages with said link.

6. The vehicle door lock device with a super lock mechanism according to claim 4, wherein said super lock member is secured to an output shaft of the motor.

* * * * *